US009586081B2

(12) United States Patent
Lagree et al.

(10) Patent No.: US 9,586,081 B2
(45) **Date of Patent: *Mar. 7, 2017**

(54) EXERCISE MACHINE HANDLE SYSTEM

(71) Applicant: Lagree Technologies, Inc., Burbank, CA (US)

(72) Inventors: Sebastien Anthony Louis Lagree, West Hollywood, CA (US); John C. Hamilton, Santa Clarita, CA (US)

(73) Assignee: Lagree Technologies, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/332,636

(22) Filed: Oct. 24, 2016

(65) Prior Publication Data

US 2017/0036057 A1 Feb. 9, 2017

Related U.S. Application Data

(63) Continuation of application No. 14/841,210, filed on Aug. 31, 2015, now Pat. No. 9,474,924, which is a continuation of application No. 13/924,088, filed on Jun. 21, 2013, now Pat. No. 9,119,989.

(60) Provisional application No. 61/719,757, filed on Oct. 29, 2012.

(51) Int. Cl.

| | |
|---|---|
| ***A63B 26/00*** | (2006.01) |
| ***A63B 21/00*** | (2006.01) |
| ***A63B 21/02*** | (2006.01) |
| ***A63B 23/12*** | (2006.01) |

(52) U.S. Cl.
CPC ..... *A63B 21/15* (2013.01); *A63B 21/02* (2013.01); *A63B 21/4035* (2015.10); *A63B 21/4045* (2015.10); *A63B 23/12* (2013.01)

(58) Field of Classification Search
CPC ..... A63B 21/1465; A63B 21/1469
See application file for complete search history.

(56) References Cited

U.S. PATENT DOCUMENTS 4,226,415 A * 10/1980 Wright ..... A63B 23/03525 482/113
4,397,462 A * 8/1983 Wilmarth ..... A63B 21/0087 482/113

(Continued)

*Primary Examiner* — Sundhara Ganesan
*Assistant Examiner* — Rae Fischer
(74) *Attorney, Agent, or Firm* — Neustel Law Offices; Michael S. Neustel

(57) ABSTRACT

An exercise machine handle system which provides a unique handle and rotatable handle hub configuration to aid in performing a variety of exercises. The exercise machine handle system generally includes one or more handle assemblies each having a mounting bracket adapted to be removably secured to an exercise machine and including an upwardly-extending mounting hub shaft. A handle hub having a pair of curved handles extending in opposite directions therefrom is rotatably securable around an upper end of the handle hub shaft into a variety of locked positions. A third curved handle extends from an upper end of the handle hub in a similarly rotatably securable position. By removably securing one or more handle assemblies to an exercise machine, a user can benefit from a wide range of exercises supported by the adjustable handle assemblies.

19 Claims, 17 Drawing Sheets

(56) References Cited

U.S. PATENT DOCUMENTS

| | | | | |
|---|---|---|---|---|
| 4,725,057 | A * | 2/1988 | Shifferaw | A63B 21/026 482/121 |
| 5,211,617 | A * | 5/1993 | Millen | A63B 21/0455 482/127 |
| 7,803,095 | B1 | 9/2010 | Lagree | |
| 8,641,585 | B2 * | 2/2014 | LaGree | A63B 21/023 482/92 |

* cited by examiner

EXERCISE MACHINE HANDLE SYSTEM

CROSS REFERENCE TO RELATED APPLICATIONS

The present application is a continuation of U.S. application Ser. No. 14/841,210 filed on Aug. 31, 2015 which issues on Oct. 25, 2016 as U.S. Pat. No. 9,474,924, which is a continuation of U.S. application Ser. No. 13/924,088 filed on Jun. 21, 2013 now issued as U.S. Pat. No. 9,119,989, which claims priority to U.S. Provisional Application No. 61/719,757 filed Oct. 29, 2012. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an exercise machine and more specifically it relates to an exercise machine handle system which provides a unique handle configuration to aid in performing a variety of exercises.

Description of the Related Art

Any discussion of the related art throughout the specification should in no way be considered as an admission that such related art is widely known or forms part of common general knowledge in the field.

In 1912 England, Joseph Pilates worked as a self-defense instructor for detectives at Scotland Yard. At the outbreak of World War I, Pilates was interned in a detention camp as an "alien enemy". While interned, Pilates refined his ideas and trained other internees in his system of exercise. He rigged springs to hospital beds, enabling bedridden patients to exercise against spring resistance, an innovation that led to his ultimate development of what is known today as a Pilates apparatus.

In 1926, Pilates immigrated to the United States and opened the first "Pilates" fitness studio. Professional dancers were the first to embrace Pilates' workouts in earnest. Of the many Pilates students who became teachers in their own Pilates studios, Ron Fletcher opened a Pilates' studio in Beverly Hills, Calif. Hollywood celebrities discovered Pilates via Fletcher's studio. The public follows the stars, and in the late 1990s, the media started profiling Hollywood stars who used Pilates apparatuses, and the market for Pilates studios across the United States expanded explosively. Today, over 10 million Americans practice Pilates, and the numbers continue to grow.

The physiological benefits to persons using Pilates apparatuses for exercise are two-fold, combining flexibility and strength training: (a) use of the apparatus increases users' flexibility and range of motion by allowing the user positioned on a sliding carriage to move towards or away from one end of the apparatus on a rolling carriage biasly connected to one of the ends of the apparatus by one or more springs, and (b) use of the apparatus increases lean muscle tissue development by working muscles against variable spring tension as a reasonable substitute for lifting dumbbells or other heavy weights.

With various features installed on the apparatus, namely handles, pulleys, ropes and bars, users can variably use pushing or pulling motions against the spring tension in order to exercise different muscles or muscle groups.

Since the 1990s, Pilates apparatuses have become a standard pieces of equipment in fitness studios and health clubs, and are used for physical therapy and rehabilitation, dance medicine and sports medicine, athletic training and conditioning, and general fitness for specialized audiences—for example, the out-of-shape, over 50 year old population, or fitness programs for pregnant, soon-to-be mothers.

Despite the nearly 100 year-long history of Pilates, the core design of the Pilates apparatus has remained substantially unchanged, although additional accessories using the spring tension have been devised, cosmetic and material changes have allowed production of apparatuses that are lower cost to produce, or more pleasing to the eye.

This status quo acceptance of antiquated Pilates apparatus design has failed to incorporate substantial improvements to mechanisms and user operation, resulting in what the medical community know recognizes as potentially dangerous and often injury-causing deficiencies.

Because of the inherent problems with the related art, there is a need for a new and improved exercise machine handle system which provides a unique handle configuration to aid in performing a variety of exercises.

BRIEF SUMMARY OF THE INVENTION

The invention generally relates to an exercise machine system which includes one or more handle assemblies, each including a mounting bracket adapted to be removably secured to an exercise machine and including an upwardly-extending mounting hub shaft. A handle hub having a pair of curved handles extending in opposite directions therefrom is rotatably securable around an upper end of the mounting hub shaft into a variety of positions. A third curved handle extends from an upper end of the handle hub. By removably securing one or more handle assemblies to an exercise machine, a user can benefit from a wide range of exercises supported by the adjustable handle assemblies.

Persons exercising on a Pilates apparatus often first position themselves on an exercise carriage that rolls along parallel rails. Once mounted on the exercise carriage, a person uses handles to push or pull the carriage along the rails, and against a bias tension typically created by springs attached between the rolling carriage and one end of the apparatus.

The present invention is a novel multi-axis and rotational handle assembly that vastly improves the functionality of a Piltates apparatus. Two of the assemblies are required on any given Pilates apparatus, the assemblies being substantially mirror images of each other, with the first assembly installed on the one side of the longitudinal axis of the Pilates apparatus, and the second assembly being installed on the opposite side of the longitudinal axis, both assemblies being aligned along the same axis that is perpendicular to the longitudinal axis.

Where handle assembly is referred to in the singular, if should be understood that such reference also refers to a second handle assembly that is substantially a mirror image of the first referred to handle assembly.

Therefore, one exemplary embodiment of the present invention is to create an exercise apparatus handle assembly upon which more than two handles are positioned at different dimensions as measured above the plane formed by the top surface of the rolling carriage.

Yet another exemplary embodiment of the present invention is to create an exercise apparatus handle assembly with a plurality of handles that are ergonomically positioned to allow optimum support for the wrist, elbow, ankle, knee, hip, shoulder, and other major joints of a person exercising on a Pilates apparatus.

Yet another exemplary embodiment of the present invention is to create an exercise apparatus handle assembly with a plurality of handles that are positionable at the start of an exercise routine, thereafter allowing a person exercising to rapidly change hand positions from one handle to another handle when transitioning from one exercise to a different exercise without stopping the exercise routine to alter the apparatus configuration.

Another exemplary embodiment of the present invention is to create an exercise apparatus handle assembly with a plurality of handles that allow a fitness trainer to direct exercising persons to rapidly change hand positions to a different handle prior to resuming an exercise routine. To those skilled in the art, it will become obvious that this functionality is substantially more time efficient when a trainer is teaching one, or a group of exercisers, and requires exercising persons to rapid transition hand positions from one handle to another handle in order to follow directions related to the next exercise in a sequence of exercises in a workout routine.

The height, weight, arm length, leg length, torso length, shoulder width and many other physical measurements of persons exercising on a Pilates apparatus vary widely. Therefore, another exemplary embodiment of the present invention is to create an exercise apparatus handle assembly with a plurality of handles positioned to allow ease of use by different sized persons without time-consuming or complicated apparatus readjustment.

Yet another exemplary embodiment of the present invention is to create an exercise apparatus handle assembly with a plurality of handles that are rotatably repositionable about an axis perpendicular to the horizontal surface of the rolling carriage in order to accommodate the wide differences in physical dimension of persons exercising, thereby better aligning exercisers' hand positions upon the apparatus to reduce unwanted stress on joints, to mitigate injury, and to provide more comfort to the exerciser.

Further, another exemplary embodiment of the present invention is to create an exercise apparatus handle assembly with a plurality of handles adjustable along multiple axis relative to the rolling carriage of a Pilates apparatus to aid in the proper exercise position for enhanced safety and comfort of the person exercising.

These and other embodiments will become known to one skilled in the art, especially after understanding the significant commercial advantages, the ability to complete a workout routine in a reduced amount of time, enhanced injury prevention, the ability to rapidly change the position of a body upon the apparatus to exercise different sets of muscles, and the significantly expanded apparatus flexibility to provide more comfort to a wide population of people of different sizes without reconfiguring a Pilates apparatus for each individual. The present invention is not intended to be limited to the disclosed embodiments.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
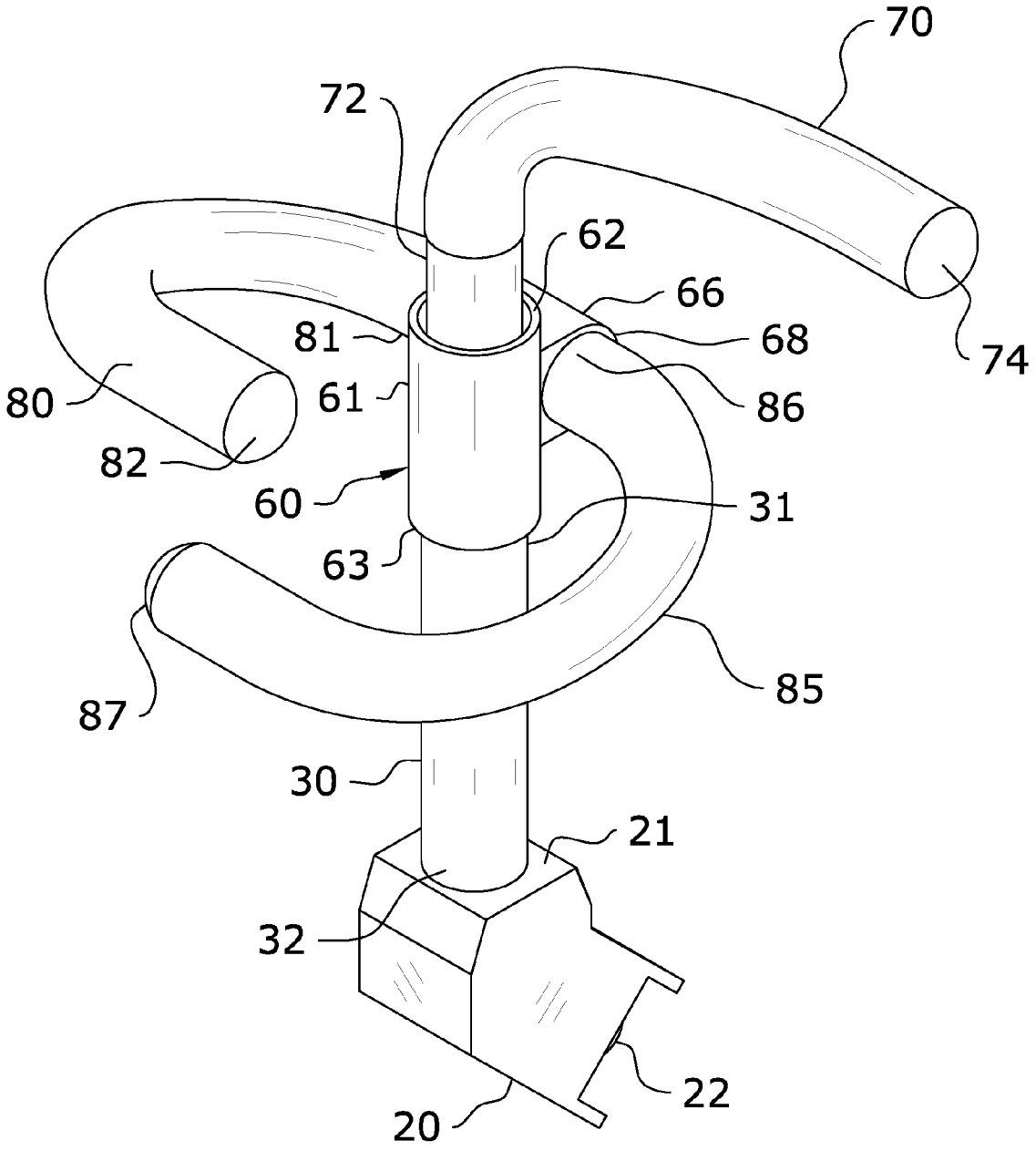
FIG. 1 is an upper perspective view of a handle assembly of the present invention.

Turning now descriptively to the drawings, in which similar reference characters denote similar elements throughout the several views, FIGS. 1 through 17 illustrate a exercise machine handle system 10, which comprises handle assemblies 11, 12 including a mounting bracket 20 adapted to be removably secured to an exercise machine 90 and including an upwardly-extending mounting hub shaft 30. A handle hub 60 having a pair of curved handles 80, 85 extending in opposite directions therefrom is rotatably securable around an upper end 31 of the mounting hub shaft 30 into a variety of positions. A third curved handle 70 extends from an upper end 62 of the handle hub 60. By removably securing one or more handle assemblies 11, 12 to an exercise machine 90, a user can benefit from a wide range of exercises supported by the adjustable handle assemblies 11, 12.

B. Handle Assembly

As shown throughout the figures, the present invention comprises a handle assembly 11 which broadly comprises a mounting bracket 20, a mounting hub shaft 30 extending upwardly from the mounting bracket 20, and a handle hub 60 rotatably and lockably secured to the mounting hub shaft 30. A pair of side handles 80, 85 extend outwardly in opposite directions from the handle hub 60. An upper handle 70 similarly extends upwardly from the handle hub 60, the upper handle 70 being either fixedly secured thereto or rotatably locked thereto.

The phrase "handle assembly" is used herein to mean one of two handle assemblies 11, 12 located upon an exercise apparatus, the assemblies 11, 12 being mirror images of each other, both of which are located on an axis orthogonal to the longitudinal axis of the exercise apparatus. It should be recognized that the description of, or reference to one handle assembly 11 shall apply to a second handle assembly 12 that is substantially a mirror image of the first.

Further, although "handle assembly" implies the human interface contact point of an exercise machine 90 upon which human hands are placed, the disclosure is not limiting, and can be interchangeably mean "foot bar assembly" upon which a person may push against using their feet in order to primarily exercise the muscles of the legs and back.

i. Mounting Bracket.

The handle assembly 11 will generally include a mounting bracket 20 having an upper end 21 and a lower end 22. The mounting bracket 20 may be comprised of various structures, devices, and configurations adapted to be removably secured to an exercise machine 90 such as a pilates machine as shown in the figures.

Figure 3:
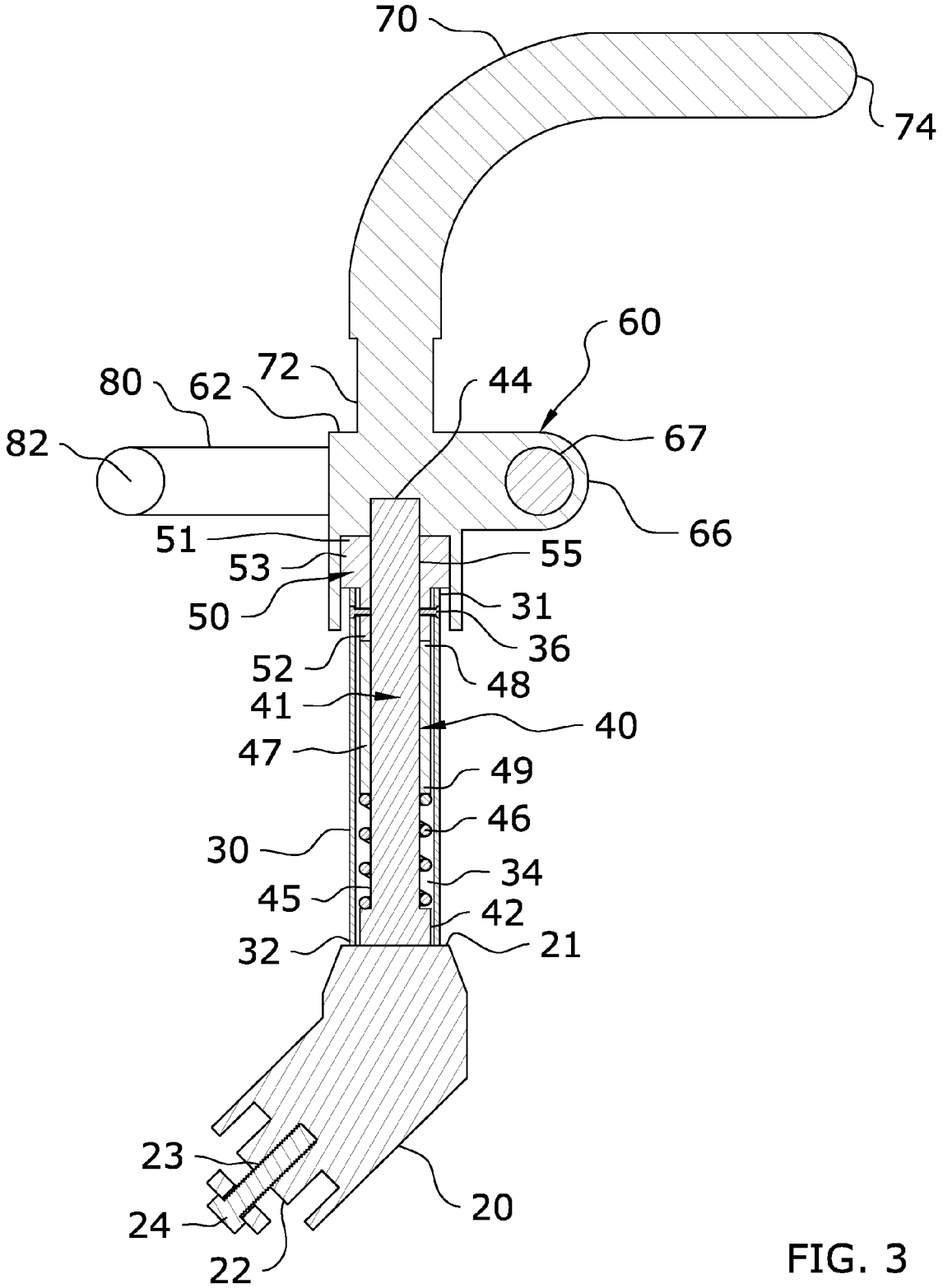
FIG. 3 is a side sectional view of a handle assembly of the present invention.
Figure 4:
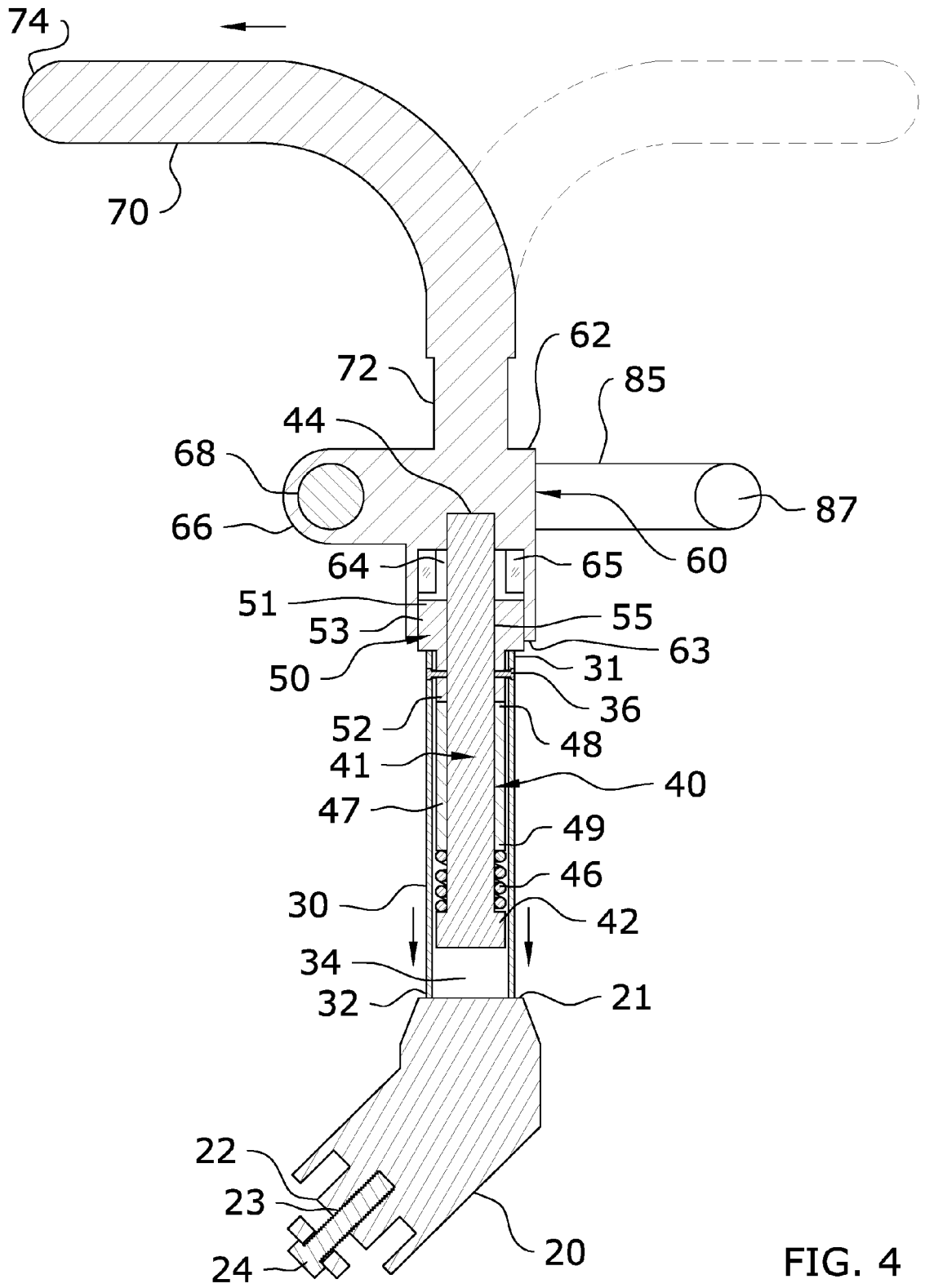
FIG. 4 is side sectional view of a handle assembly of the present invention illustrating rotation of the handle hub.
Figure 5:
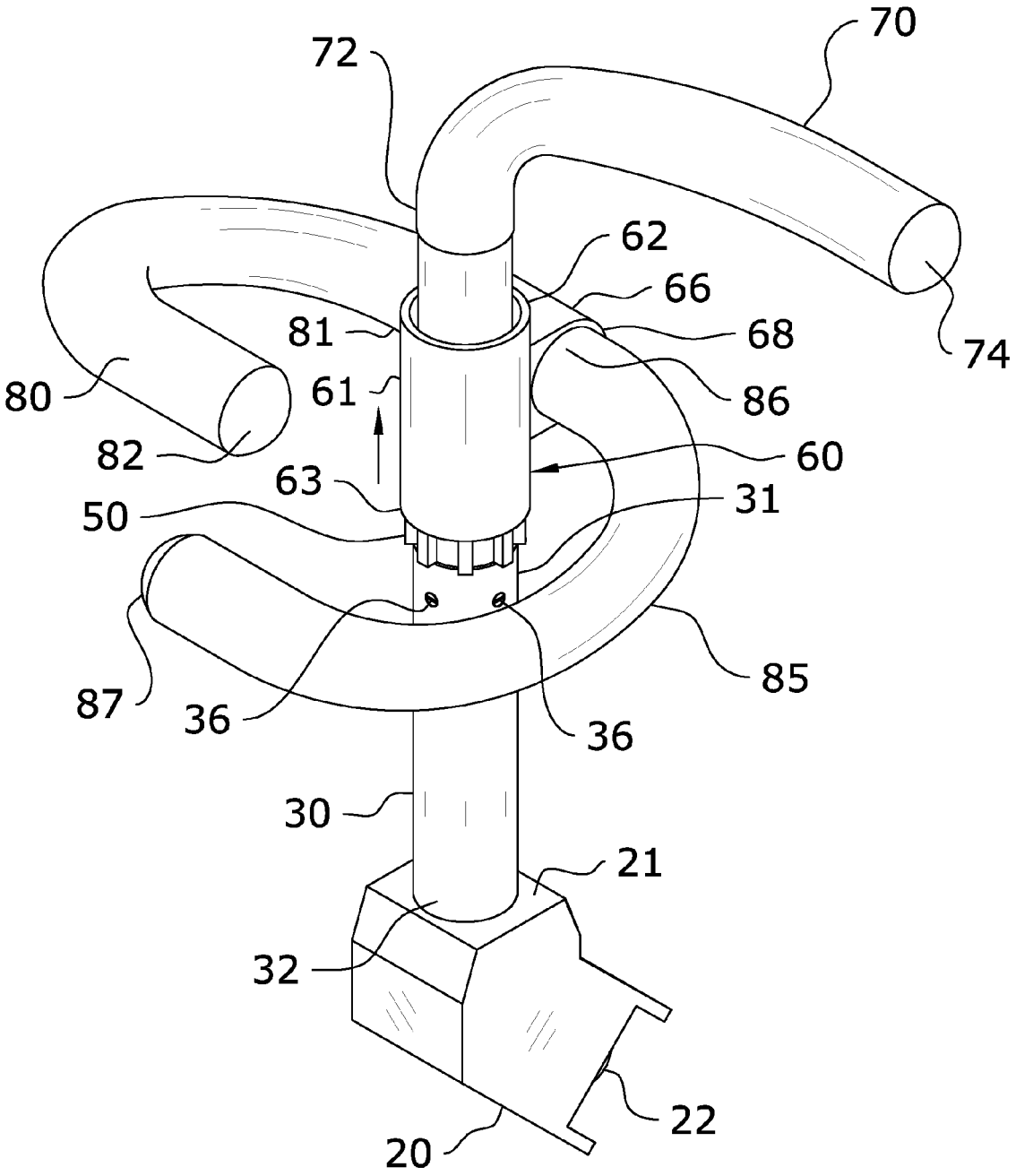
FIG. 5 is an upper perspective view of a handle assembly of the present invention in an unlocked state.
Figure 6:
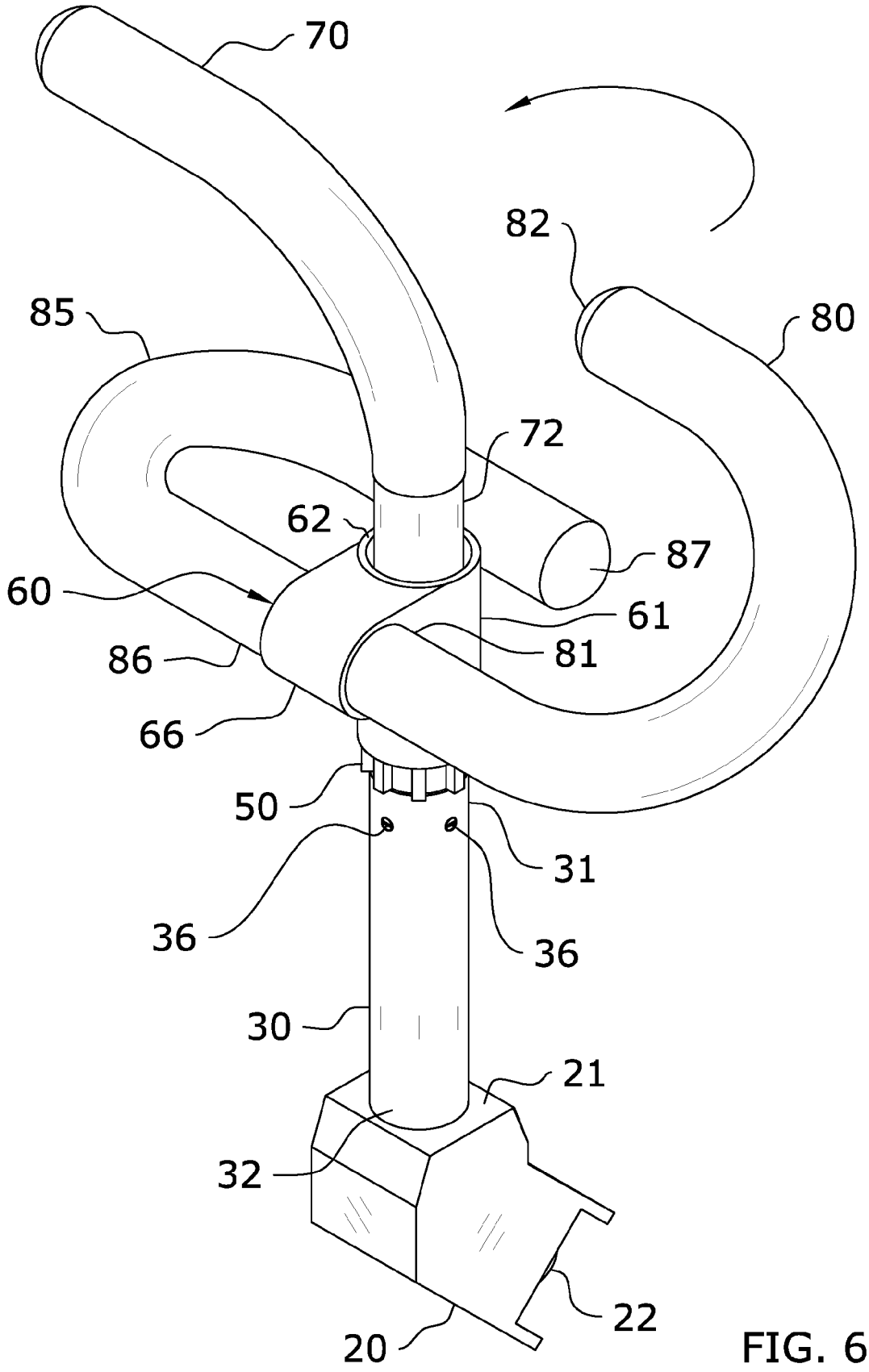
FIG. 6 is an upper perspective view of a handle assembly of the present invention being rotated in an unlocked state.
Figure 7:
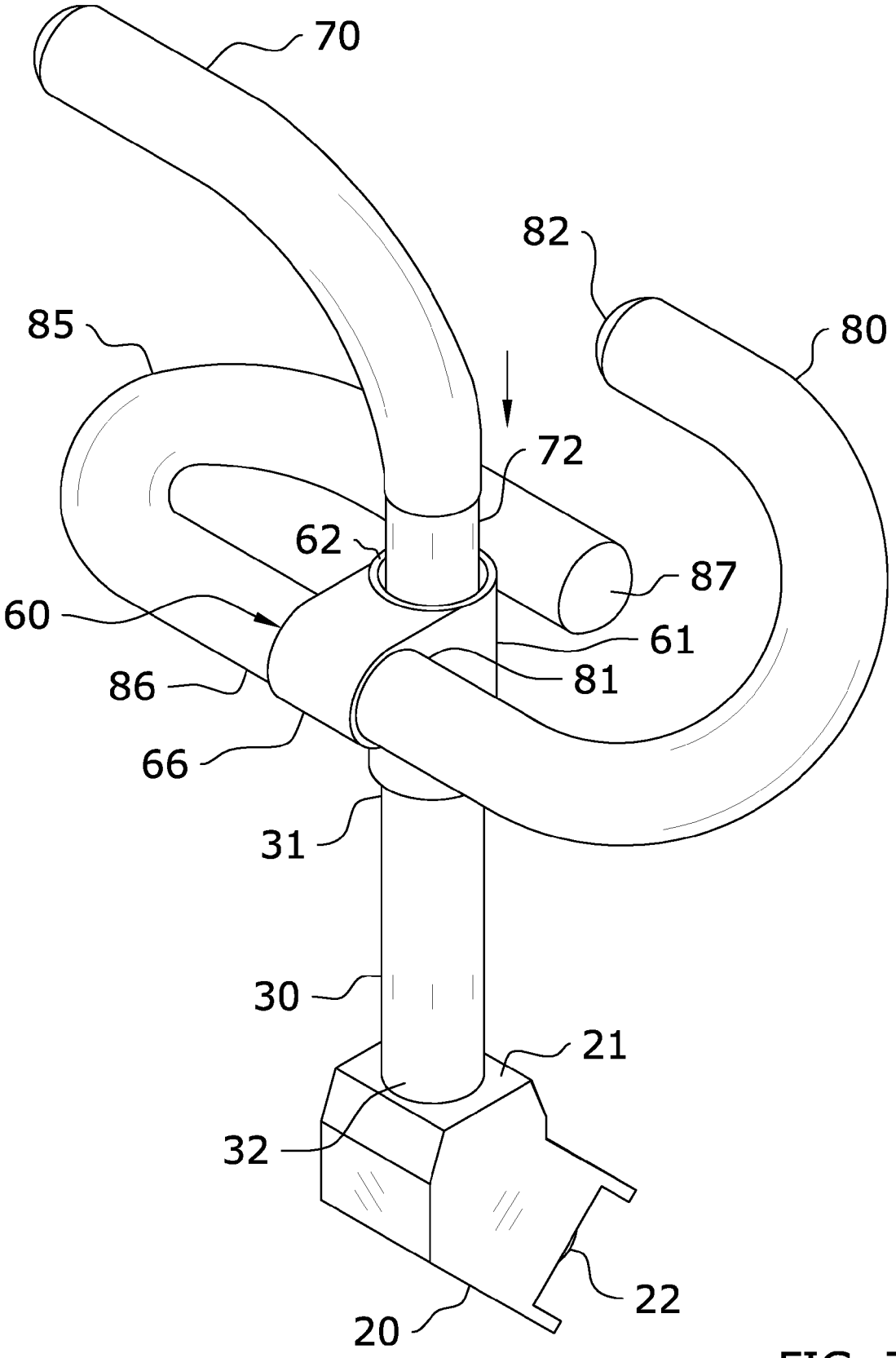
FIG. 7 is an upper perspective view of a handle assembly of the present invention in a locked state after rotation.

In a preferred embodiment as best shown in FIGS. 3-4, the lower end 22 of the mounting bracket 20 will include a clamping structure having an aperture 23 through which a securing member 24 such as a pin or fastener may be threadably secured to removably secure the mounting bracket 20 to the exercise machine 90.

Figure 2:
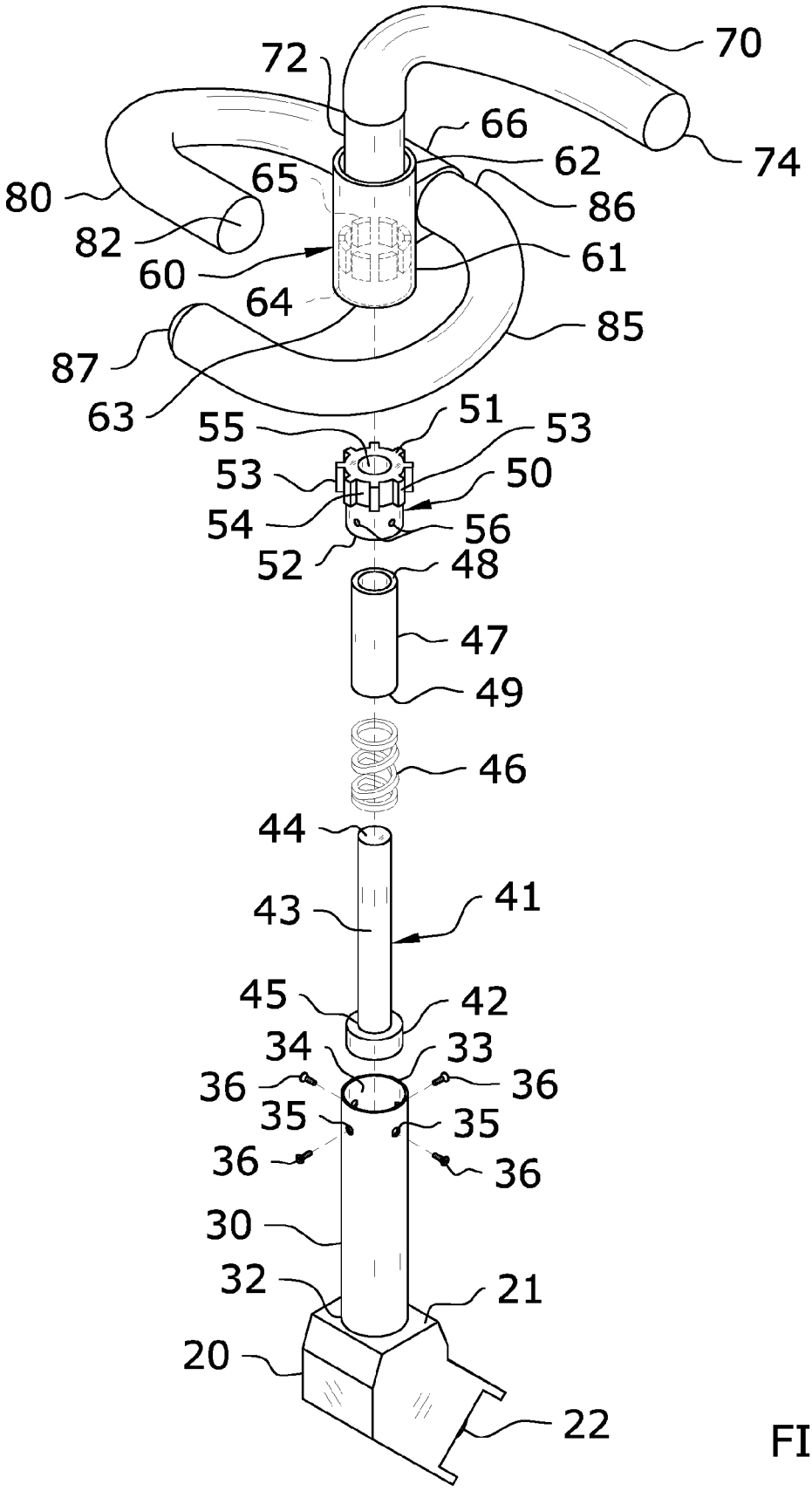
FIG. 2 is an exploded view of a handle assembly of the present invention.

FIG. 2 best illustrates a mounting hub shaft 30, which extends upwardly from the upper end 21 of the mounting bracket 20. The mounting hub shaft 30 may be integrally formed with the mounting bracket 20 or they may be comprised of discrete structures secured together.

Although the figures illustrate the mounting hub shaft 30 being hollow, it is appreciated that, in some embodiments, the mounting hub shaft 30 may be solid. In a preferred embodiment as shown in the figures, the mounting hub shaft 30 is comprised of a hollow, cylindrical tube having an upper opening 33 at its upper end 31 and a lower end 32 which is fixedly secured (or integral with) the upper end 21 of the mounting bracket 20. The upper opening 33 in the upper end 31 of the mounting hub shaft 30 leads to an internal channel 34 in which the various components of the adjustment assembly 40 are housed.

In some embodiments as shown in FIG. 2, the mounting hub shaft 30 includes one or more apertures 35 positioned around its outer circumference adjacent its upper end 31. These apertures 35 may be aligned with corresponding apertures 56 on the collar 50 of the adjustment assembly 40 so that the collar 50 may be secured to the mounting hub shaft 30 via one or more fasteners 36 as best shown in FIGS. 3 and 4.

ii. Handle Hub.

As best shown in FIG. 3, a handle hub 60 is included which is rotatably secured to the upper end 31 of the mounting hub shaft 30. The handle hub 60 is rotatable into a plurality of locked positions by utilizing an adjustment assembly 40 as described herein. Preferably, the handle hub 60 will be rotatable such that the handle hub 60 may be locked into approximately 45 degree intervals, though other configurations may be utilized.

As best shown in FIGS. 3-7, the handle hub 60 is movable longitudinally with respect to the mounting hub shaft 24 preferably without allowing the handle hub 60 to be fully removed from the mounting hub shaft 24. The handle hub 60 is movable from a locked state to an unlocked state, wherein the locked state prevents rotation of the handle hub 60 and wherein the unlocked state allows free rotation of the handle hub 60 about the mounting hub shaft 24. The handle hub 60 is movable in a first longitudinal direction (generally downward) to the locked state and in a second longitudinal direction (generally upward) to the unlocked state to allow free rotation. As described below, the handle hub 60 will preferably be biased toward the locked state such that, absent force, the handle hub 60 will revert back into the locked state.

The handle hub 60 comprises a base connector 61 and a side support 66 extending from one side of the base connector 61 as best shown in FIG. 2. The base connector 61 comprises a tube member having an upper end 62, a lower opening 63, and an internal cavity 64 extending between the upper end 61 and the lower opening 63. The lower opening 63 is preferably rotatably secured around the upper end 31 of the mounting hub shaft 30 as best shown in FIGS. 3 and 4. The upper handle 70 of the present invention is either fixedly or rotatably secured to the upper end 62 of the base connector 61, depending on the embodiment of the present invention as described herein.

The side handle support 66 may be comprised of a similar tube-like configuration which is fixedly secured to the outer circumference of the base connector 61 in an orientation such that the base connector 61 and side handle support 66 are perpendicular with respect to each other as shown in the figures. The side handle support 66 includes a first end 67 and a second end 68, wherein the first side handle 80 of the present invention is fixedly secured to the first end 67 of the side handle support 66 and the second side handle 85 of the present invention is fixedly secured to the second end 68 of the side handle support 66.

iii. Adjustment Assembly.

The handle hub 60 is rotatable around the upper end 31 of the mounting hub shaft 30 into a plurality of locked positions by utilizing an adjustment assembly 40, which is operable to longitudinally move the handle hub 60 from its locked state to its unlocked state. A variety of adjustment assemblies 40 known in the art to allow a hub to be rotatably locked into a plurality of positions about a rod may be utilized for the present invention.

In some embodiments, the upper end 31 of the mounting hub shaft 30 or the lower end 63 of the base connector 61 may comprise a tapered collet so as to allow the handle hub 60 to be selectively rotated into a plurality of frictionally-locked positions about the mounting hub shaft 30. Other exemplary adjustment assemblies 40 include a mechanism comprised of mating female and male features which lock at predetermined angles, interlocking teeth on two gears, or any other known rotational locking mechanism. In another embodiment, rotating a threaded collar or threaded clamp would release a collet, thus allowing the handle hub 60 to be rotated about the mounting hub shaft 30. Upon being rotated into the desired position, the threaded collar or threaded clamp could be re-tightened to re-engage the collet and fix the handle hub 60 in position.

In a preferred embodiment as best illustrated in FIGS. 2-4, the adjustment assembly 40 comprises an anchoring member 41 which is slidably positioned within the inner channel 34 of the mounting hub shaft 30. The anchoring member 41 comprises a circular base portion 42 and an elongated rod portion 43 extending upwardly from the base portion 42 as best illustrated in FIG. 2. The upper end 44 of the anchoring member 41 is fixedly secured within the handle hub 60 such that upward force on the handle hub 60 will draw the anchoring member 41 upwards. The lower end 45 of the anchoring member 41 is left free.

A bias member 46, preferably comprised of a downwardly-biased coil spring 46 as shown in FIG. 2, is coiled around the rod portion 43 of the anchoring member 41, with the bottom end of the bias member 46 rests or is secured against the base portion 42 of the anchoring member 41 and the top end of the bias member 46 rests or is secured against a lower end 49 of a tube member 47 which similarly extends around the rod portion 43 of the anchoring member 41 at a position above the coil spring 46. The upper end 48 of the tube member 47 rests against the lower end 52 of the collar 50 of the present invention as shown in FIG. 3. The rod portion 43 extends fully through the bias member 46 and tube member 47.

The collar 50 is utilized to lock the handle hub 60 into a plurality of radial positions with respect to the mounting hub shaft 30. The collar 50 generally comprises a cylindrical structure having an upper end 51 and a lower end 52 which is positioned within the lower opening 63 of the base connector 61 of the handle hub 60.

The collar 50 includes a plurality of radial protrusions 53 extending outwardly from its outer circumference, preferably adjacent to its upper end 51, which define a plurality of radial slots 54 adapted to matingly engage with a plurality of locking members 65 positioned in the internal cavity 64 of the base connector 61 of the handle hub 60. The rod portion 43 of the anchoring member 41 extends fully through a channel 55 extending through the hollow collar 50, with the upper end 44 of the rod portion 43 being fixed within the handle hub 60.

The collar 50 includes a plurality of apertures 56 along its outer circumference which are adapted to align with corresponding apertures 35 on the upper end 31 of the mounting hub shaft 30 such that fasteners 36 may be extended therethrough to secure the collar 50 within the upper opening 33 of the mounting hub shaft 30 as shown in FIGS. 3 and 4.

By applying upward force to the handle hub 60, such as by pulling on one of the handles 70, 80, 85, the base connector 61 of the handle hub 60 will be drawn upward to disengage its internal locking members 65 from the radial slots 54 of the collar 50 and enter an unlocked state. In such an unlocked state with the locking members 65 so disengaged, the handle hub 60 may be freely rotated into a plurality of positions.

When pulled upward, the bias member 46 will be compressed between base portion 42 of the adjustment assembly 40 and the lower end 49 of the tube member 47 due to the base portion 42 being drawn upward through the hollow tube member 47 and collar 50 as shown in FIG. 4. When such force is released, the downward bias of the bias member 46 will force the anchoring member 41 (and attached handle hub 60) to be drawn back down, and the locking members 65 will re-engage with the radial slots 54, thus locking the handle hub 60 back to a locked state in a new position.

iv. Handles.

As shown throughout the figures, the handle assembly 11 of the present invention generally includes an upper handle 70 extending upwardly from the handle hub 60, a first side handle 80 extending in a first side direction from the handle hub 60, and a second side handle 85 extending in a second side direction from the handle hub 60.

The figure merely illustrate exemplary for the positioning of the first, second and third handles 70, 80, 85 of the present invention. It should be noted that the handles 70, 80, 85 in the figures are generally shown as being locked into a particular configuration. However, the handles 70, 80, 85 may be unlocked, rotated to any desired angle about the mounting hub shaft 30, and re-locked in order to achieve a different handle configuration.

Each of the handles 70, 80, 85 may be grasped by a person exercising, such as on an exercise machine 90. In some cases, the handles 70, 80, 85 may be used as footrests against which force may be applied through the leg muscles, thereby allowing the person exercising to move the carriage assembly 92 away from the handle end by pushing against the one or more handles 70, 80, 85. The distances between any two of the handles 70, 80, 85 is large enough such that a person may reasonably and comfortably grasp one handle without encountering interference from any other.

As shown throughout the figures, the first handle 80 comprises a curved, U-shaped configuration and extends in a first direction from the side handle support 66 of the handle hub 60. The proximal end 81 of the first side handle 80 is preferably secured to the side handle support 66. The first side handle 80 curves between its proximal end 81 and its distal end 82. The first side handle 80 comprises a middle handle with respect to the other handles, with its distal end 82 being at an elevation between that of the respective distal ends 87, 74 of the second side and upper handles 85, 70.

The second side handle 85 similarly comprises a curved, U-shaped configuration and extends in a second direction from the side handle support 66, the second direction being oppositely oriented with respect to the first direction of the first side handle 80. The proximal end 86 of the second side handle 85 is secured to the side handle support 66 on an opposite side with respect to the first side handle 80. The second side handle 85 curves between its proximal end 86 and its distal end 87. The second side handle 85 preferably comprises a lower handle with respect to the other handles, with its distal end 87 being at a lower elevation than that of the respective distal ends 82, 74 of the first side and upper handles 80, 70.

The upper handle 70 may be comprised of a curved, substantially L-shaped configuration similar to the first and second side handles 80, 85, or, preferably, may be comprised of a right-angle configuration as shown in the figures. In some embodiments, proximal end 72 of the upper handle 70 will be fixedly secured to the upper end 62 of the handle hub 60, such as is shown in FIGS. 1-7.

Figure 8:
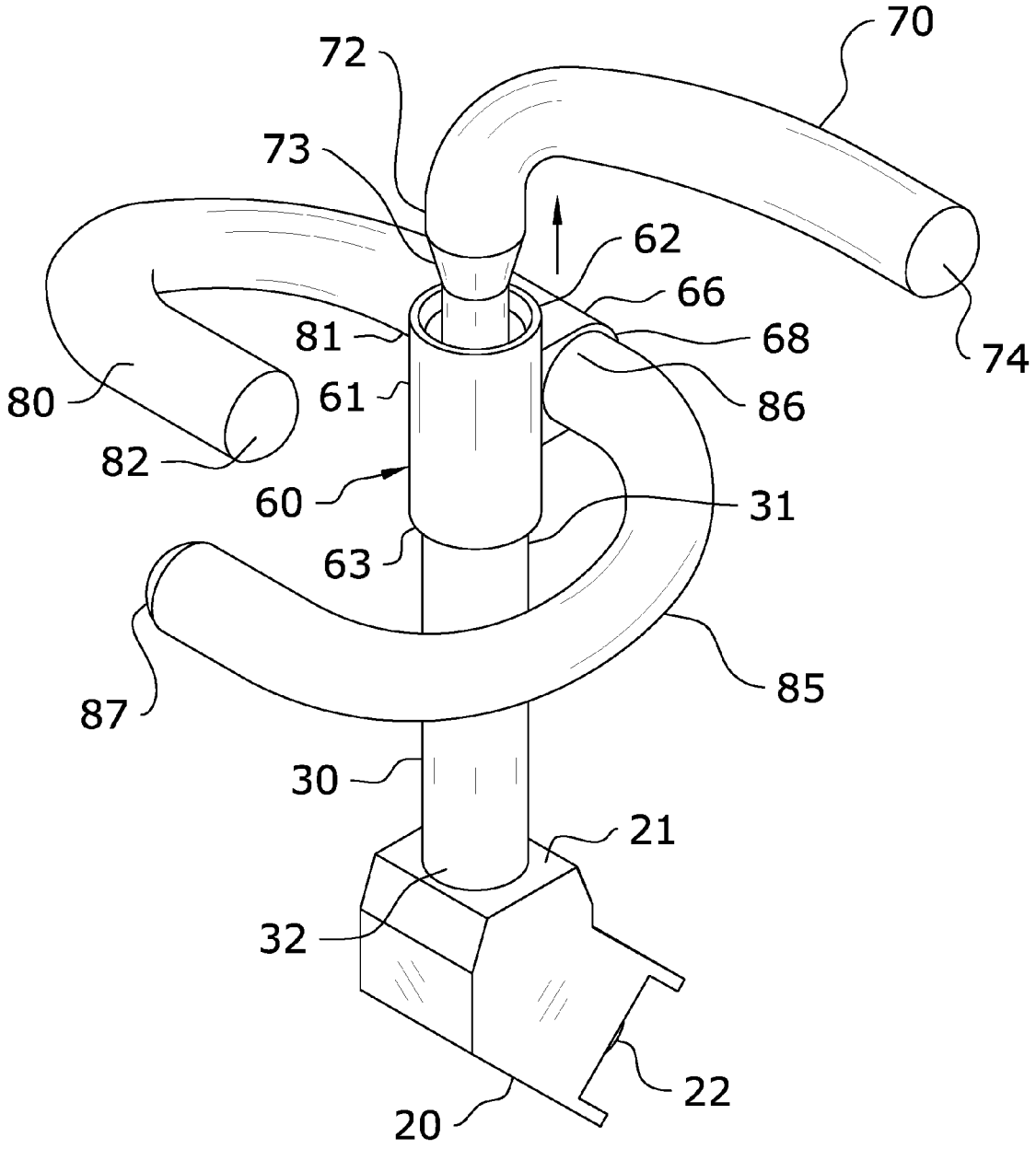
FIG. 8 is an upper perspective view of an alternate embodiment of a handle assembly of the present invention utilizing a rotatable upper handle.
Figure 9:
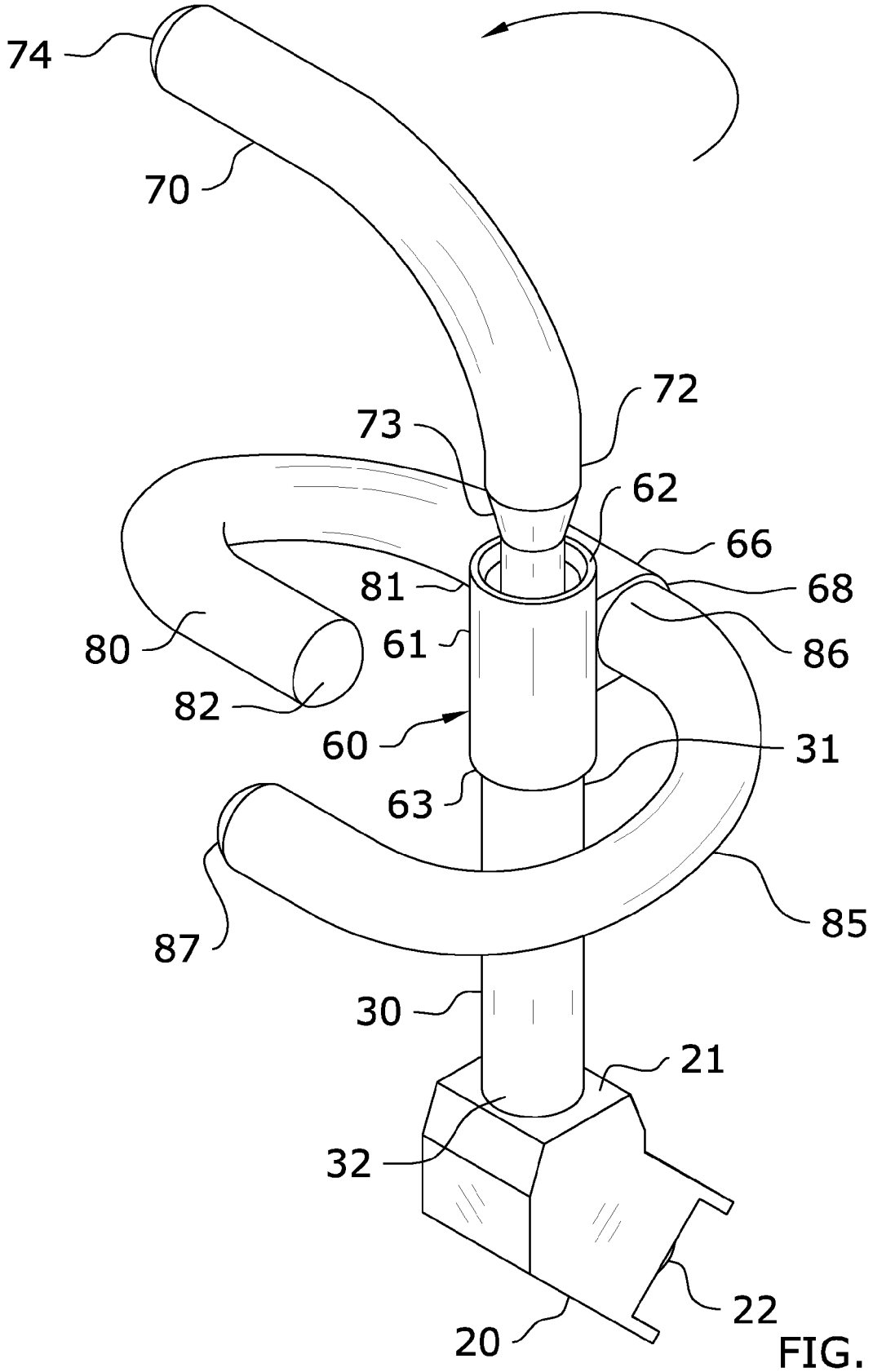
FIG. 9 is an upper perspective view of an alternate embodiment of a handle assembly of the present invention illustrating adjustment of the rotatable upper handle.
Figure 10:
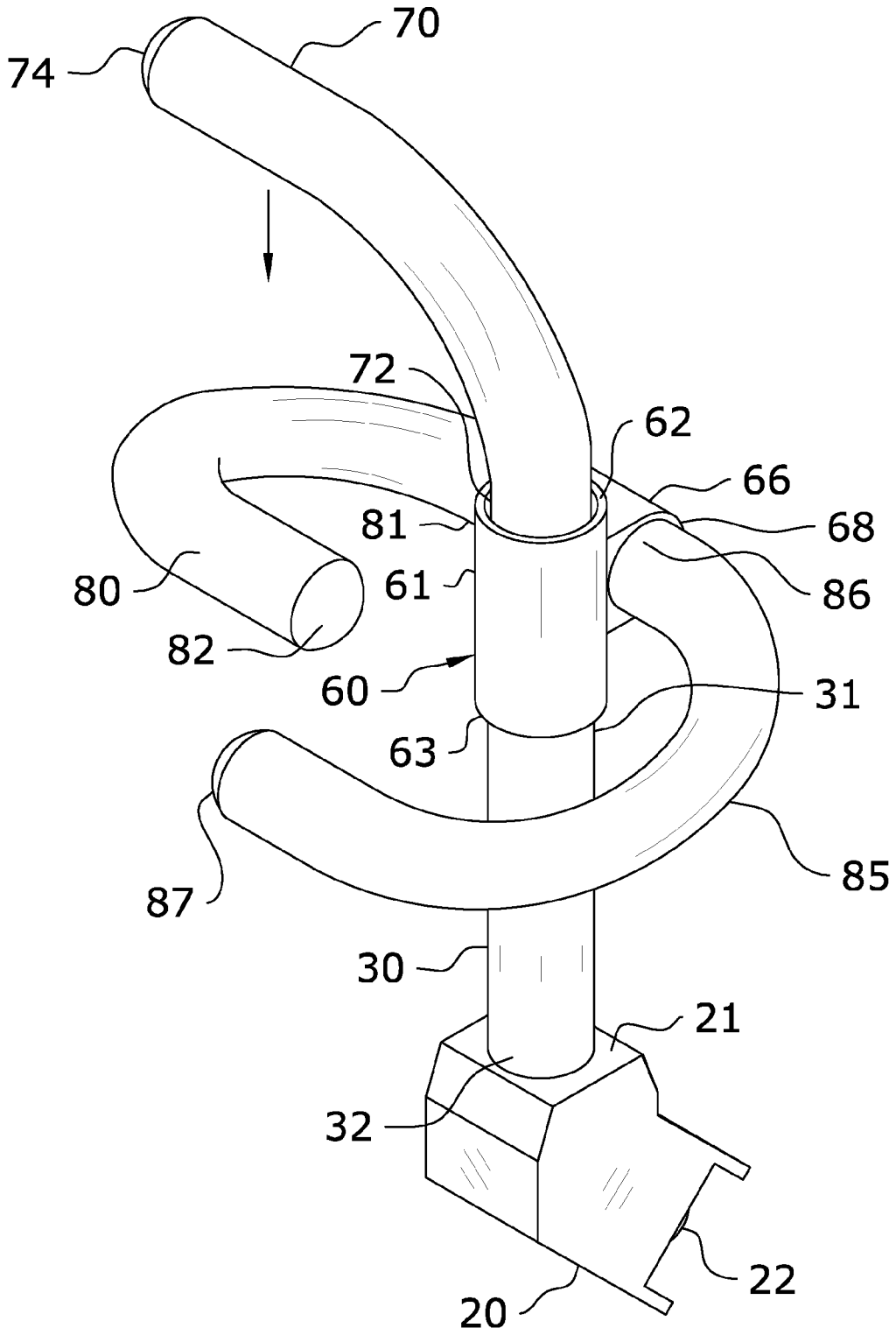
FIG. 10 is an upper perspective view of an alternate embodiment of a handle assembly of the present invention illustrating locking of the rotatable upper handle in a rotated position.

In other embodiments, such as shown in FIGS. 8-10, the upper handle 70 may be rotatably locked into a plurality of positions with respect to the handle hub 60. Various adjustment configurations may be utilized for the upper handle 70, including any of those previously disclosed with respect to the rotational locking of the handle hub 60 about the mounting hub shaft 30.

In a preferred embodiment shown in FIGS. 8-10, the proximal end 72 of the upper handle 70 will include a tapered collet 73 which frictionally engages within the upper end 62 of the base connector 61 when fully pushed in but disengages when pulled out such that the upper handle 70 may be freely rotated before being pushed back in and thus re-engaged in a frictional manner. The distal end 74 of the upper handle 70 preferably extends in a perpendicular direction with respect to the handle hub 60 and is at a higher elevation than that of the respective distal ends 82, 87 of the side handles 80, 85.

C. Exercise Machine

The handle assemblies 11, 12 of the present invention may be utilized with a wide range of exercise machines 90. FIGS. 11-17 illustrate an exemplary embodiment in use with a Pilates machine 90. The exercise machine 90 shown therein comprises a base 91 with a carriage assembly 92 slidably secured thereon. A person positioned upon the rolling carriage assembly 92, while maintaining their position under the carriage, pushes their hands or feet against one or more of the handles 70, 80, 85 of the handle assemblies 11, 12.

Figure 11:
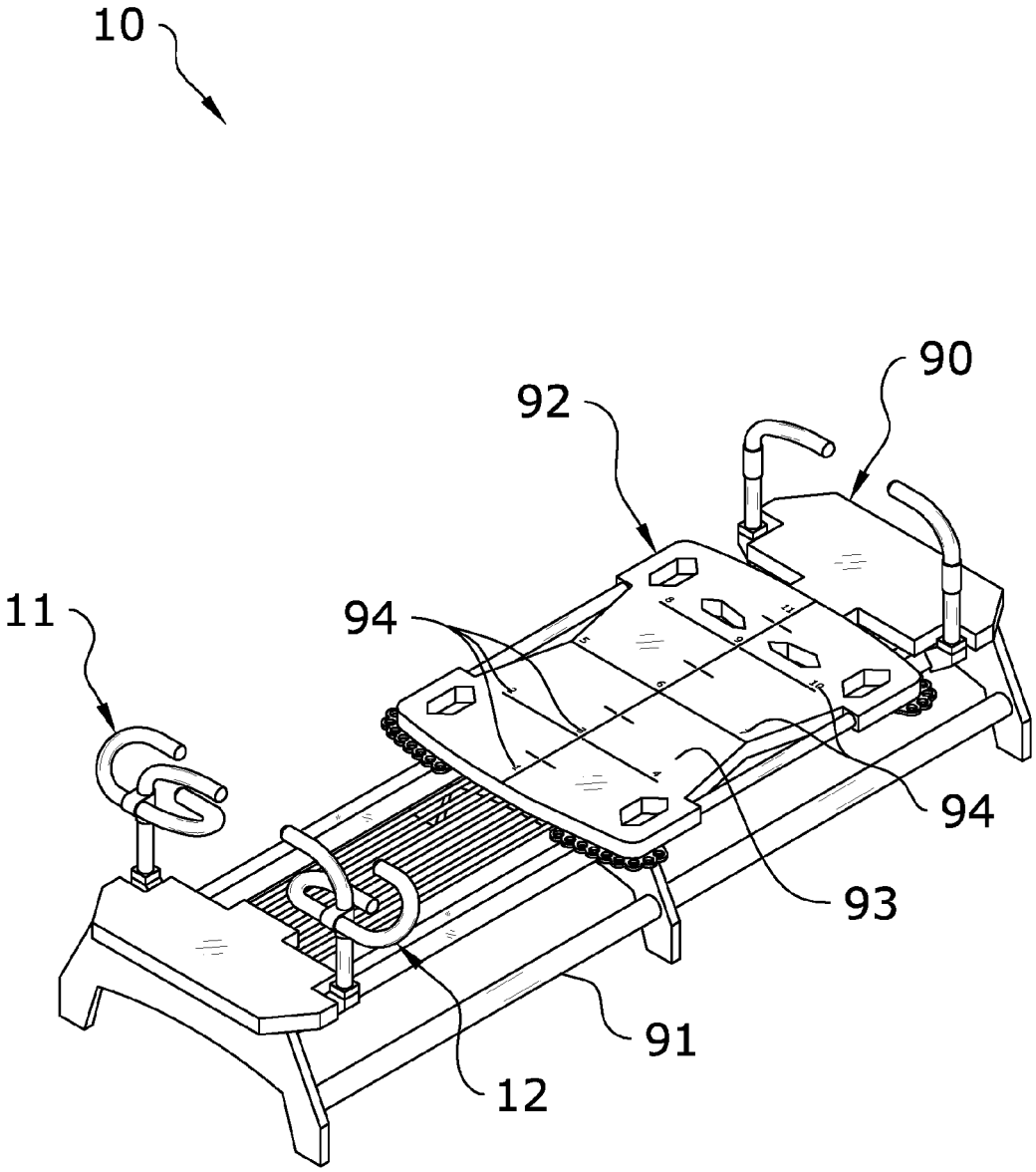
FIG. 11 is an upper perspective view of present invention with the carriage assembly in an extended position.

FIG. 11 illustrates an exemplary diagram showing a Pilates machine 90 with its carriage assembly 92 located in the tensed position, and the approximate location of the handle assemblies 11, 12 thereon. As shown therein, the two handle assemblies 11, 12 are mirror reflections of each other, and are substantially aligned along an X-Axis. However, the handle assemblies 11, 12 need not be mirror images of each other after one or more handles 70, 80, 85 thereof are rotated.

D. Operation of Preferred Embodiment

Figure 12:
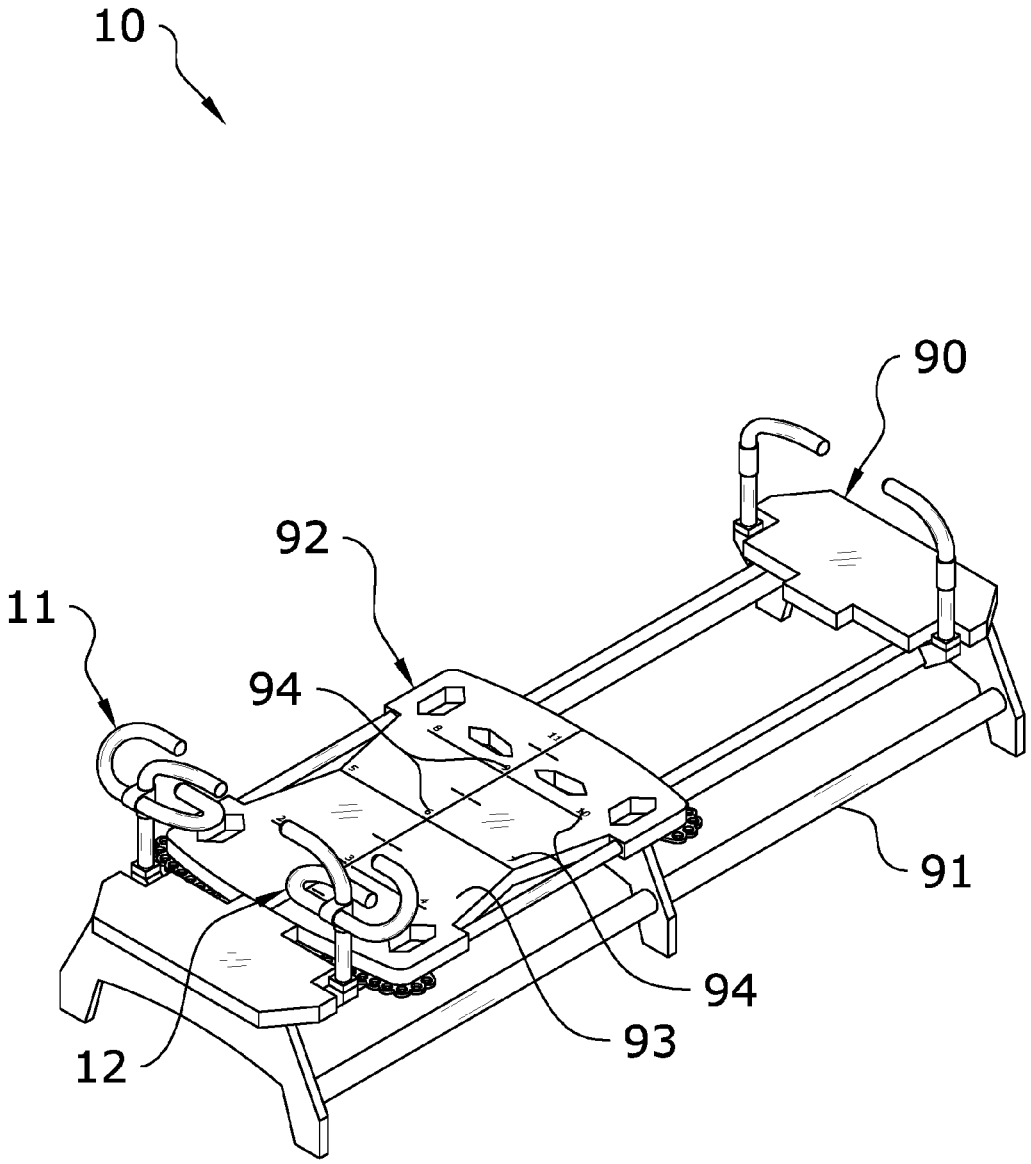
FIG. 12 is an upper perspective view of present invention with the carriage assembly in a retracted position.

FIG. 12 illustrates the carriage assembly 92 in its rested position. A person positioned upon the rolling carriage assembly 92, while maintaining their position upon the carriage 92, pushes their hands or feet against one or more of the handles 70, 80, 85 of the handle assemblies 11, 12, thereby causing the carriage 92 to move along the rails on the exercise machine's 90 base 91 against a spring bias assembly which connects the carriage assembly 92 to the end of the base 91 proximal to the handle assemblies 11, 12.

Figure 13:
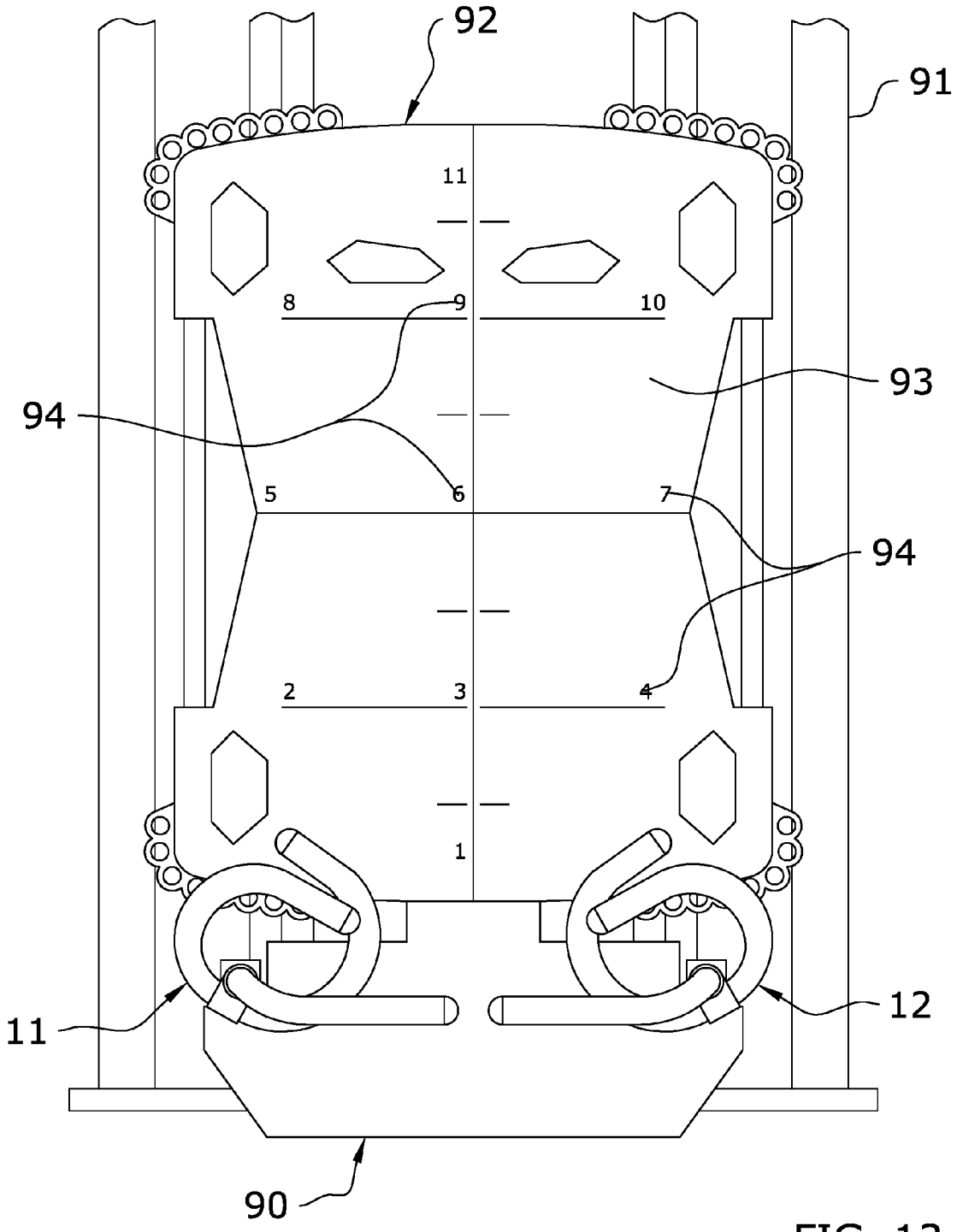
FIG. 13 is a top view of the carriage assembly of the present invention.

FIG. 13 illustrates the carriage assembly 92 of the exercise machine 90, which may include one or more positioning indicia 94 for aiding in various exercises. The positioning indicia 94 may be comprised of numbers which may be referenced by an exercise instructor or manual to aid in a user positioning his/her body on the carriage assembly 92 to more efficiently exercise with the exercise machine 90.

FIGS. 14-17 illustrate an individual using the present invention. It will become known to one skilled in the art that by rotating the opposed handles 70, 80, 85 inward, and toward each other, a person with narrow shoulders may grab the handles 70, 80, 85 with their hands, more comfortably accommodating the relatively narrow stature of the person, and reducing the possibility of injuring wrist, elbow or shoulder joints that could result from incorrectly aligned anatomy during exercise.

Similarly, will become obvious to one skilled in the art that by rotating the opposed handles 70, 80, 85 outward, and away each other, a person with wide shoulders may grab the handles 70, 80, 85 with their hands, more comfortably accommodating the relatively broad stature of the person, and reducing the possibility of injuring wrist, elbow or shoulder joints that could result from incorrectly aligned anatomy during exercise.

Figure 14:
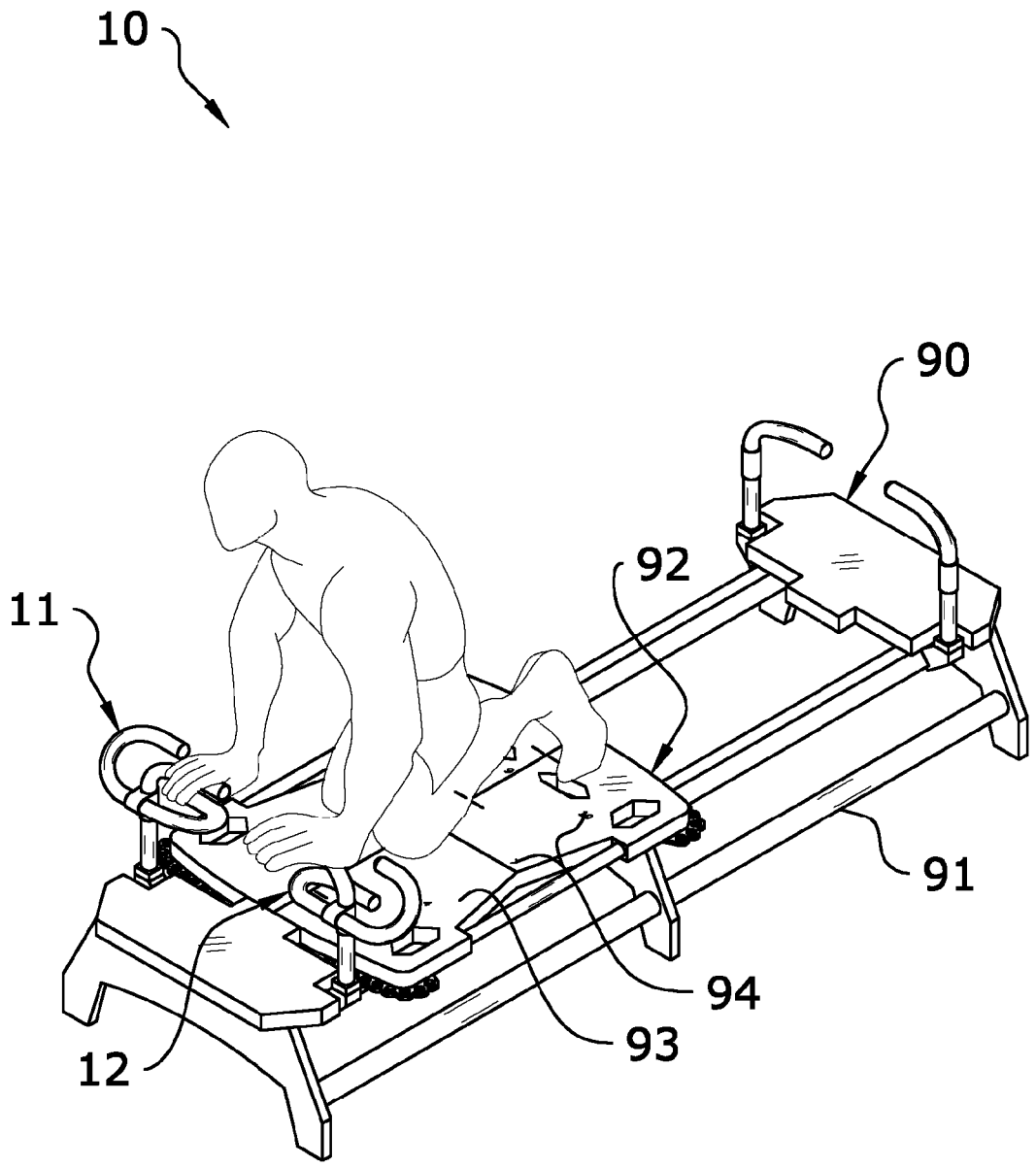
FIG. 14 is a first upper perspective view of the present invention in use.

FIG. 14 illustrates a person kneeling upon the carriage assembly 92 in a position at the start of an exercise. The hands are positioned closely together to facilitate the increased workload on the triceps muscles of the upper arms, rather than increasing the muscle loading on the trapezius muscles of the upper back and neck. This position also reduces workload on the deltoid muscles of the shoulder in the event that the deltoid muscles have been injured, and a lighter muscle loading is required to promote rehabilitation or reduce the chances of injury.

Figure 15:
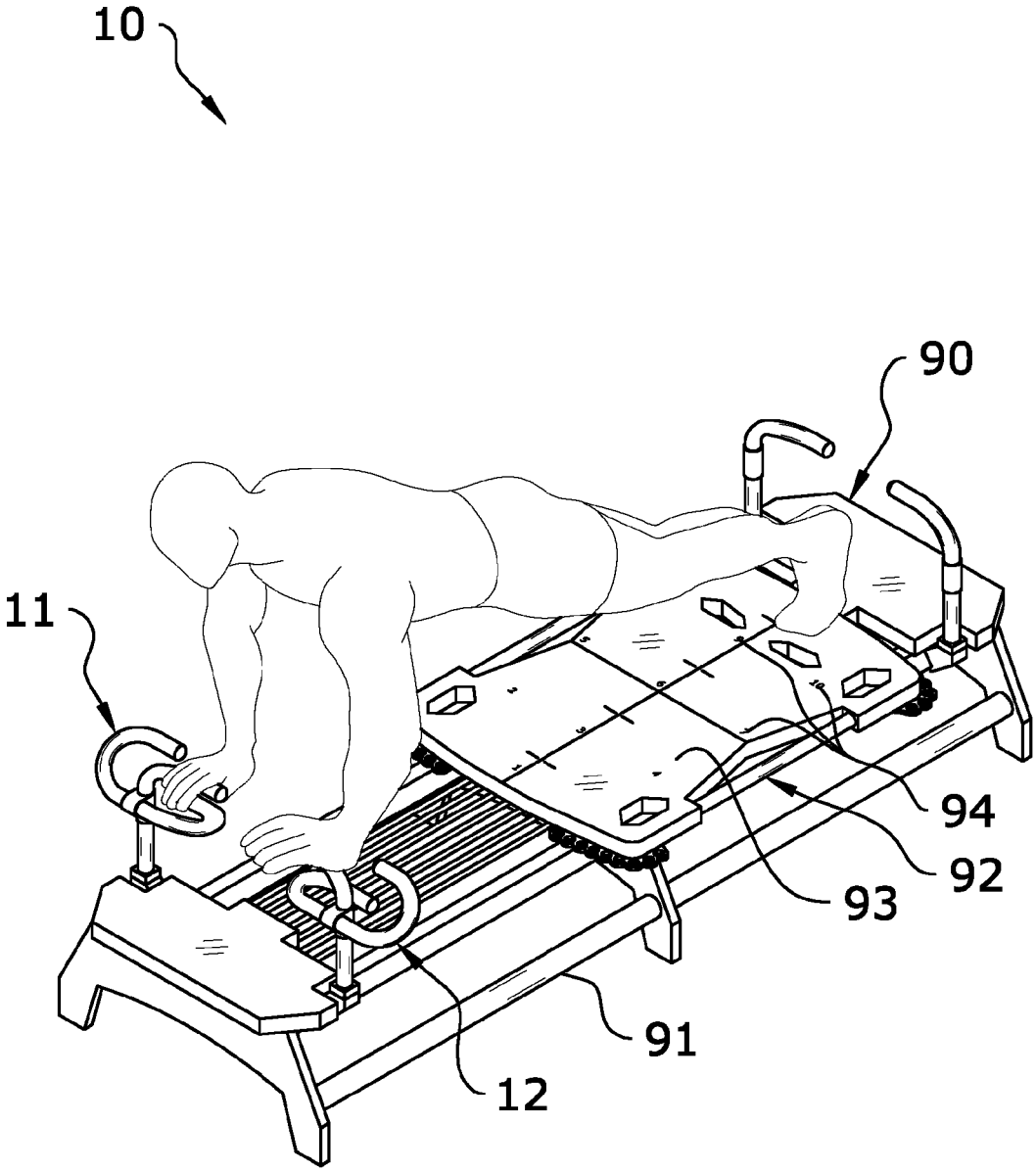
FIG. 15 is a second upper perspective view of the present invention in use.

FIG. 15 illustrates a person positioned upon the carriage assembly 92 in its working position with the hands being positioned on upper handles 70 being pointed toward each other. By arranging the hands closely together, the person has increased the workload on the triceps muscles by pushing against the handle assemblies 11, 12 of a Pilates apparatus.

Figure 16:
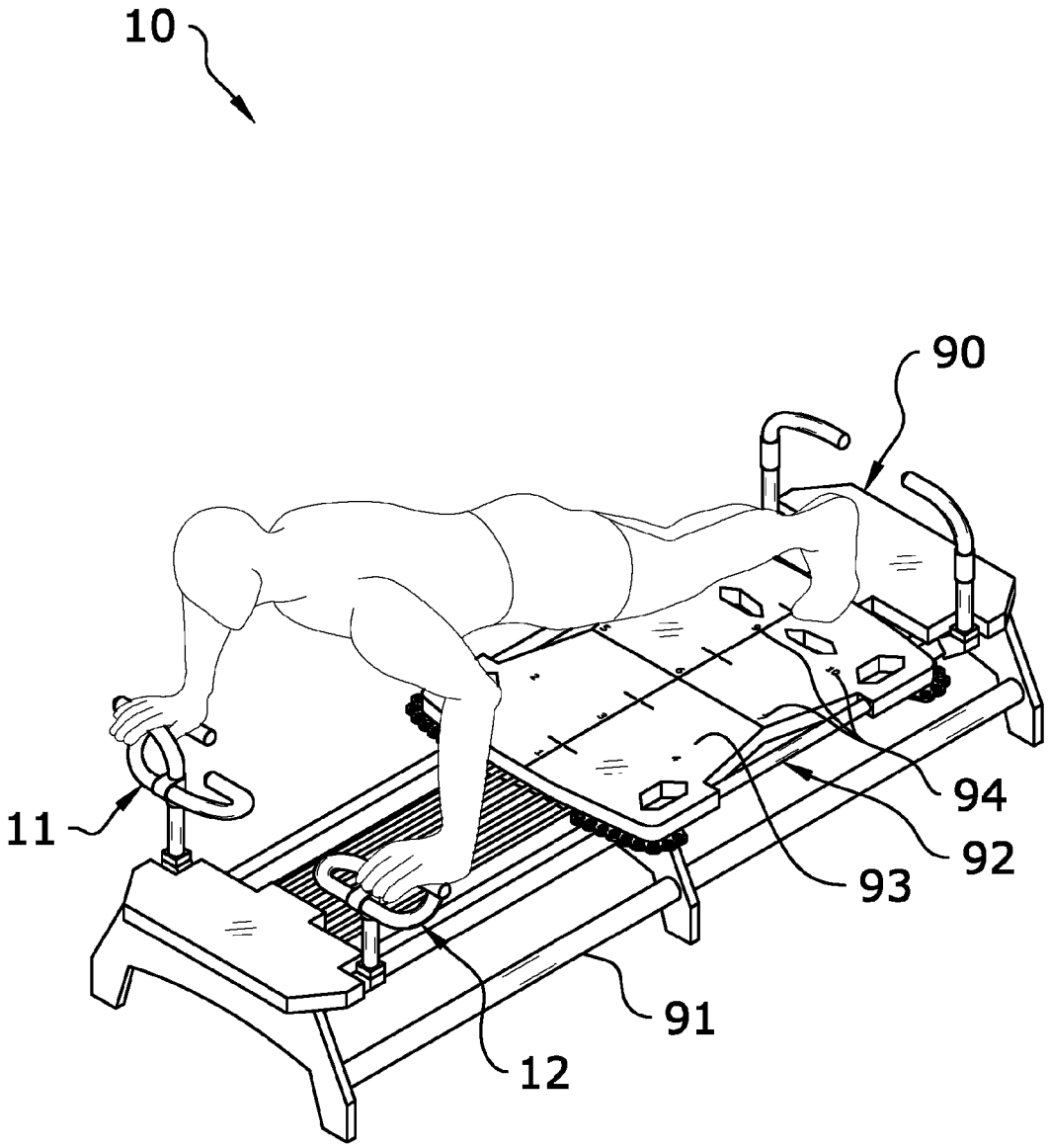
FIG. 16 is a third upper perspective view of the present invention in use.

FIG. 16 illustrates a person positioned upon the carriage assembly 92 in its working position with the hands being positioned on the upper handles 70 with the body being raised off of the carriage assembly 92, thereby expending additional muscle energy in the workout compared to a person who did not additionally lift their weight vertically off of the carriage 92. As it will become known to one skilled in the art, the upper handles 70 upon which the illustrative person is holding require more exercise energy output to raise the body higher, than holding handles 80, 85 at a lower position which would have required less work. In other words, by using the upper handles 70, the person has created a more beneficially intense workout than would have been possible using lower-positioned handles.

Figure 17:
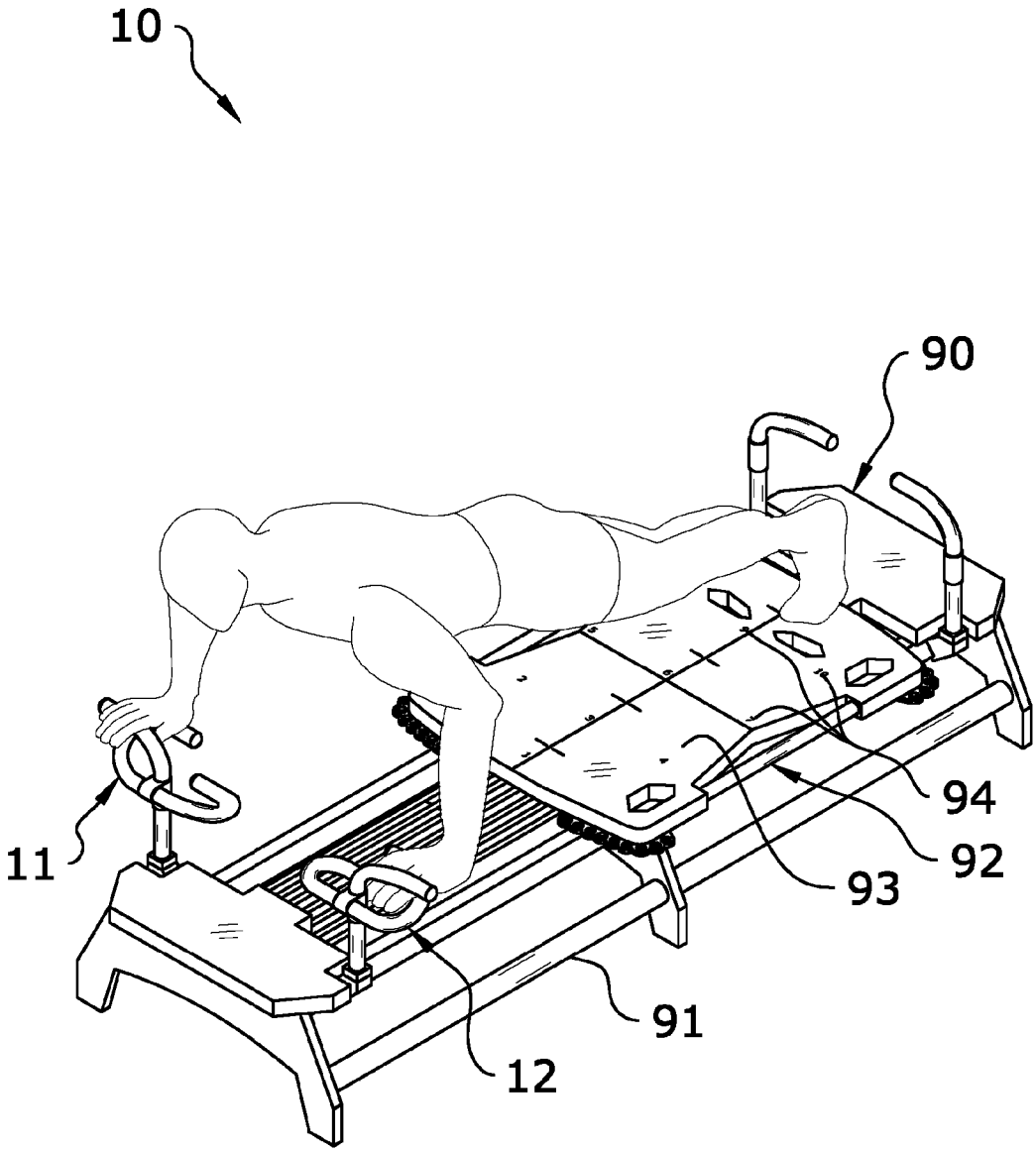
FIG. 17 is a fourth upper perspective view of the present invention in use.

FIG. 17 is an exemplary diagram illustrating an orthographic view of a figure of a person positioned upon the rolling carriage 92 located in its working position on a Pilates machine 90. By arranging the hands on handles 70, 80, 85 at different widths and elevations, the person can focus workload on muscles that would not be equivalently worked if the hands were in mirrored positions. As will become known to one skilled in the art, human bodies are not entirely symmetrical, and for health or cosmetic reasons, people desire the ability to work the relatively underdeveloped muscles more than the same muscles on the other side of their bodies in order to more closely balance the asymmetry.

In this illustration, the person has placed their right hand widely upon the upper handle 70, while placing their left hand more closely to the body, and on a handle 80 that is lower in elevation than the handle used on the right side. It should be noted that, while not shown, any unique combination of handle elevation and hand width can be used in asymmetric combination. It will be readily apparent to one skilled in the art that asymmetric positioning on an exercise device advantageously facilitates the asymmetric workload on muscles, thereby relatively increasing or decreasing workload on the muscles on the right side of the body compared to the same muscles on the left side of the body.

It should be observed that describing the virtually unlimited combinations of the number of handles 70, 80, 85, handle elevations and the fixed position of those handles 70, 80, 85 relative to each other, the number of handles 70, 80, 85 that can be mounted upon a vertical column and attached to a Pilates apparatus 90, the rotation or adjustment angles of each of those handles 70, 80, 85 for the purpose of exercising different muscles or muscle groups, or to prevent injury would be exhaustive and burdensome. Therefore, it should be noted that the embodiments disclosed are not intended to be limiting, but rather merely illustrate the advantages of the present invention over previous Pilates apparatuses 90 as a result of the novel, and highly flexible design herein disclosed.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An exercise machine with an adjustable handle, comprising:
- a frame having a first end and a second end;
- a carriage movably positioned upon the frame between the first end and the second end;
- a bias member connected between the carriage and the frame that applies a bias force upon the carriage;
- a mounting hub shaft attached to the frame;
- a plurality of first projections extending from an upper portion of the mounting hub shaft;
- a handle hub rotatably secured to an upper end of the mounting hub shaft, wherein the handle hub is adapted to be locked in a plurality of positions;
- wherein the handle hub includes a plurality of locking members, wherein the plurality of locking members define a plurality of first slots between the plurality of locking members, and wherein the plurality of first projections are adapted for selectively engaging the plurality of first projections when positioned within the plurality of first slots to lock the handle hub in the locked state; and
- a first handle extending from the handle hub.

2. The exercise machine with an adjustable handle of claim 1, wherein the mounting hub shaft is comprised of a hollow tube.

3. The exercise machine with an adjustable handle of claim 1, wherein the handle hub is movable longitudinally with respect to the mounting hub shaft.

4. The exercise machine with an adjustable handle of claim 3, wherein the handle hub is movable longitudinally without allowing the handle hub to be fully removed from the mounting hub shaft.

5. The exercise machine with an adjustable handle of claim 3, wherein the handle hub is movable from a locked state to an unlocked state, wherein the locked state prevents rotation of the handle hub and wherein the unlocked state allows free rotation of the handle hub.

6. The exercise machine with an adjustable handle of claim 5, wherein the handle hub is biased toward the locked state.

7. The exercise machine with an adjustable handle of claim 5, wherein the handle hub is movable in a first longitudinal direction to the locked state and in a second longitudinal direction to the unlocked state.

8. The exercise machine with an adjustable handle of claim 1, further comprising an upper handle extending from the handle hub, wherein the upper handle is rotatably secured to an upper end of the handle hub.

9. The exercise machine with an adjustable handle of claim 1, wherein each of the plurality of first slots have a longitudinal axis substantially parallel with respect to a longitudinal axis of the mounting hub shaft.

10. The exercise machine with an adjustable handle of claim 1, including a second handle rotatably positioned with respect to the handle hub and the first handle, wherein the second handle is adapted to be locked in a plurality of second rotational positions with respect to the handle hub.

11. The exercise machine with an adjustable handle of claim 1, wherein the plurality of locking members extend inwardly.

12. The exercise machine with an adjustable handle of claim 1, wherein the plurality of first projections define a plurality of second slots, wherein the plurality of second slots defined by the plurality of first projections are adapted to receive the plurality of locking members when in the locked state.

13. An exercise machine with a plurality of adjustable handles, comprising:
- a frame having a first end and a second end;
- a first platform attached to the frame near the first end and a second platform attached to the frame near the second end;
- a carriage movably positioned upon the frame between the first end and the second end;
- a bias member connected between the carriage and the frame that applies a bias force upon the carriage;
- a plurality of adjustable handle assemblies attached to the frame, wherein each of the adjustable handle assemblies are comprised of:
  - a mounting hub shaft extending upwardly from the frame;
  - a handle hub rotatably positioned with respect to an upper end of the mounting hub shaft, wherein the handle hub is adapted to be locked in a plurality of first rotational positions with respect to the mounting hub shaft; and
  - a first handle extending from the handle hub.

14. The exercise machine with a plurality of adjustable handles of claim 13, including a second handle rotatably positioned with respect to the handle hub and the first handle.

15. The exercise machine with a plurality of adjustable handles of claim 14, wherein the second handle is adapted to be locked in a plurality of second rotational positions with respect to the handle hub.

16. An exercise machine with a plurality of adjustable handles, comprising:
- a frame having a first end and a second end;
- a carriage movably positioned upon the frame between the first end and the second end;
- a bias member connected between the carriage and the frame that applies a bias force upon the carriage;

a first pair of adjustable handles attached to the frame near the first end of the frame, wherein each of the first pair of adjustable handles is comprised of:

a mounting hub shaft extending upwardly from the frame;

a handle hub rotatably positioned with respect to an upper end of the mounting hub shaft, wherein the handle hub is adapted to be locked in a plurality of first rotational positions with respect to the mounting hub shaft; and a first handle extending from the handle hub.

17. The exercise machine with a plurality of adjustable handles of claim 16, including a second handle rotatably positioned with respect to the handle hub and the first handle, wherein the second handle is adapted to be locked in a plurality of second rotational positions with respect to the handle hub.

18. The exercise machine with a plurality of adjustable handles of claim 16, including a first platform attached to the frame near the first end and a second platform attached to the frame near the second end.

19. The exercise machine with a plurality of adjustable handles of claim 16, including a second pair of adjustable handles attached to the frame near the second end of the frame, wherein each of the second pair of adjustable handles is comprised of:

a mounting hub shaft extending upwardly from the frame;

a handle hub rotatably positioned with respect to an upper end of the mounting hub shaft, wherein the handle hub is adapted to be locked in a plurality of first rotational positions with respect to the mounting hub shaft; and a handle extending from the handle hub.

* * * * *